United States Patent [19]

Seki et al.

[11] 4,326,195

[45] Apr. 20, 1982

[54] MULTI-ITEM DATA INPUT APPARATUS

[75] Inventors: Yashiro Seki; Hideo Kobayashi, both of Tokyo, Japan

[73] Assignees: Anritsu Electric Company Limited; Systematix Co. Ltd., both of Osaka, Japan

[21] Appl. No.: 140,681

[22] Filed: Apr. 16, 1980

[30] Foreign Application Priority Data

Jun. 21, 1979 [JP] Japan ..... 54-78296

[51] Int. Cl.[3] ..... G08C 1/00; H01H 9/00; G08C 9/00

[52] U.S. Cl. ..... 340/365 R; 200/5 A

[58] Field of Search ..... 340/365 R, 365 S, 378.3; 200/5 R, 5 A, 314; 178/17 C; 400/491.2, 495.1; 179/90 K

[56] References Cited

U.S. PATENT DOCUMENTS

| | | | |
|---|---|---|---|
| 3,757,322 | 9/1973 | Barkan et al. | 340/378.3 |
| 3,826,882 | 7/1974 | Giolitti et al. | 340/365 R |
| 4,017,848 | 4/1977 | Tannas, Jr. | 340/365 R |
| 4,032,931 | 6/1977 | Haker | 340/365 R |
| 4,056,699 | 11/1977 | Jordan | 200/5 A |
| 4,059,737 | 11/1977 | Gergaud | 200/5 A |
| 4,192,976 | 3/1980 | Scott | 340/365 S |
| 4,194,099 | 3/1980 | Mickelson | 200/5 A |

*Primary Examiner*—Thomas A. Robinson
*Attorney, Agent, or Firm*—Holman & Stern

[57] ABSTRACT

A multi-item data input apparatus for manual generation of data to designate selected ones of a plurality of items, the items being visibly displayed on a flat sheet, comprising a plate having apertures therein in positions corresponding to those of the items on the sheet, a transparent key mounted in each of the apertures and movable therein within a limited range, a contact spring actuatable by each key, and a matrix of conductor elements arranged in rows and columns in relation to the contact springs such that contact between two intersecting conductors is established by actuation of any of the keys, thereby generating data designating the item which is visible through that key.

12 Claims, 6 Drawing Figures

Fig. 1B
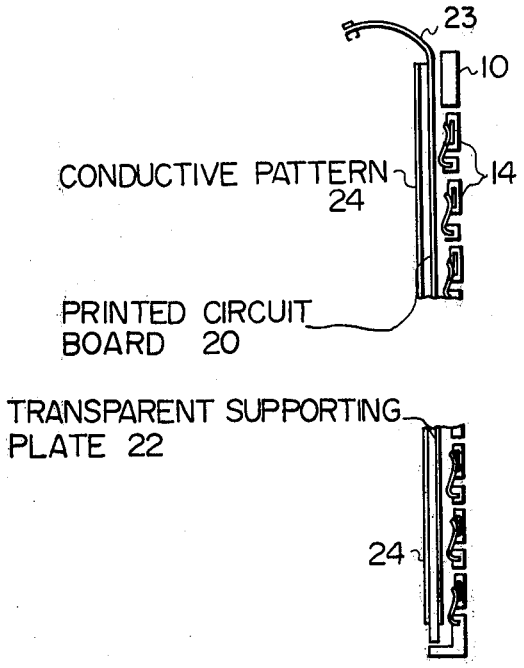
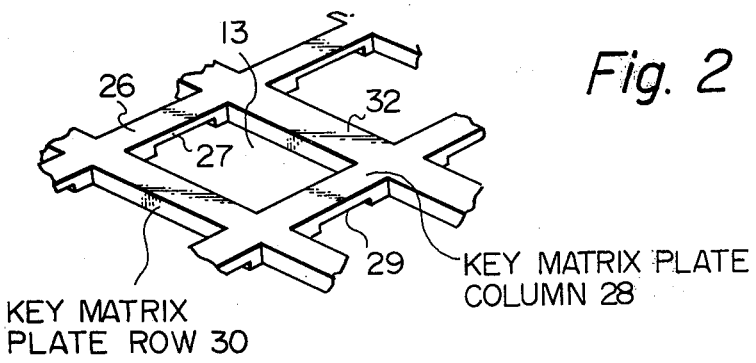
Fig. 2

MULTI-ITEM DATA INPUT APPARATUS

BACKGROUND OF THE INVENTION

In many applications, it is necessary to rapidly select particular items from a large number of other items, and to generate data which specifies the selected item. This data may be for input to a data-processing system, for example. If this item selection is to be performed by an operator, then an excessive amount of time may be required, if conventional methods of item selection are utilized. One method which has been used in the prior art to facilitate item selection has been to provide an item list in the form of a book, with pages bound together. Each page is perforated with an array of apertures, with an item appearing beside each aperture. To select a particular item, the page on which the item should appear is first looked up. This page is then placed over a device having a set of small push-buttons, each corresponding in position to an aperture on the page, and protruding through the page. The operator can then generate data such as an electrical signal to designate a selected item by actuating the push-button which is adjacent to that item.

The above method has the disadvantage that the push-buttons must necessarily be rather small, so that it is difficult for the operator to actuate them. In addition, the wiring arrangement among the buttons becomes rather complex.

Another method which has been adopted has been to employ an array of photoelectric elements rather than push-buttons, with each photoelectric element being positioned to correspond to one of the apertures in a page. The operator can then designate a selected item by touching a light pen to the aperture which is adjacent to that item, to generate an electrical signal from the corresponding photoelectric element. However, such use of a light pen is rather troublesome and time-consuming.

Touch-sensitive electrode plates, rather than push-buttons, have also been employed to generate signals designating particular items. However, such electrode plates have the disadvantage that a positive indication is not given to the operator when an item designating signal is generated. In the case of a push-button or key actuated switch, the movement of the bush-button or key when actuated provides a positive indication to the operator that actuation has been accomplished.

SUMMARY OF THE INVENTION

In the present invention, the above-mentioned disadvantages of prior art methods of items selection for data input are eliminated. This is accomplished by utilizing a keyboard having an array of transparent keys, beneath which is a matrix arrangement of conductors, in row and column formation. Actuation of one of the keys causes a contact member coupled to the key to establish contact at a corresponding intersection of a row and column conductor of the conductor matrix. A sheet is disposed below the conductor matrix, with a list of items displayed thereon, each of the items being situated immediately below a corresponding one of the transparent keys, so that each item is visible through a key. By connecting the row and column conductors to input terminals of a data-processing apparatus, data which designates a particular item is transmitted to the data-processing apparatus when the transparent key situated above that item is actuated. The row and column conductors are situated between adjacent keys, so that visibility through the keys is unobstructed.

With this method, the entire area of a key is available both for displaying the information designating an item and as a surface to be contacted by the operator's finger when key actuation is performed. Thus, it will be appreciated that the present invention enables a multi-item data input apparatus to be realized in which a desired item can be easily found by the operator, and data designating the item rapidly and conveniently generated, while enabling the operating keyboard and the sheet on which data items appear to be of relatively compact dimensions.

BRIEF DESCRIPTION OF THE DRAWINGS

In the drawings:

FIG. 1B is a partial cross-sectional view through the embodiment of FIG. 1A.

FIG. 2 is a view illustrating a portion of a key matrix plate in the preferred embodiment;

DESCRIPTION OF THE PREFERRED EMBODIMENT

Figure 1A:
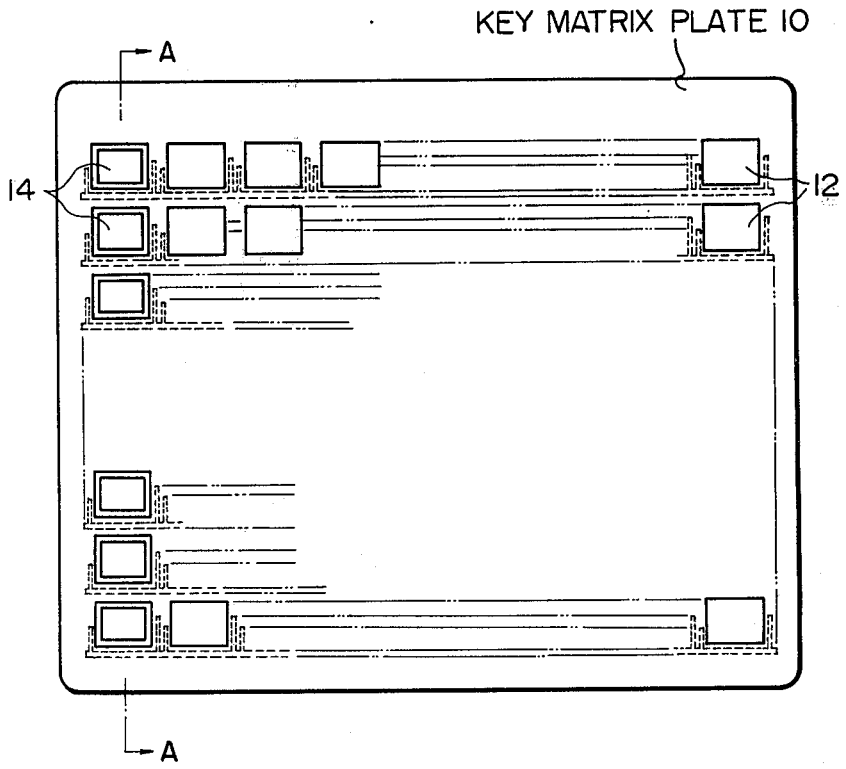
FIG. 1A is a partial plan view of a preferred embodiment of a multi-item data input apparatus according to the present invention.

FIG. 1A is a partial plan view of a preferred embodiment of a multi-item data input apparatus according to the present invention. A flat plate, denoted as key matrix plate 10, has a number of apertures provided therein, denoted by reference numeral 12. One of a set of keys 14 is contained within each of the apertures 12, such as to be movable in a direction perpendicular to key matrix plate 10 within a predetermined range.

A partial cross-sectional view through the preferred embodiment taken along line A—A in FIG. 1A is shown in FIG. 1B. The key matrix plate 10, with keys 14 mounted therein, is positioned immediately above, and parallel to, a thin and flexible printed circuit board 20, which is mounted on a transparent supporting plate 22. The construction of the preferred embodiment may be more readily understood by reference to FIGS. 2 and 3. FIG. 2 is a view of a portion of key matrix plate 10, in which a typical one of apertures 12 is denoted by numeral 13. Aperture 13 is formed within a lattice array of row members (i.e. members arranged in the horizontal direction as viewed in FIG. 1A) and column members arranged at right angles thereto. Two typical row members are denoted by numerals 30 and 32 respectively, while two column members intersecting therewith are denoted by numerals 26 and 28. Recesses 27 and 29 are provided beneath column members 26 and 28 respectively, to retain a key within aperture 13.

Figure 3:
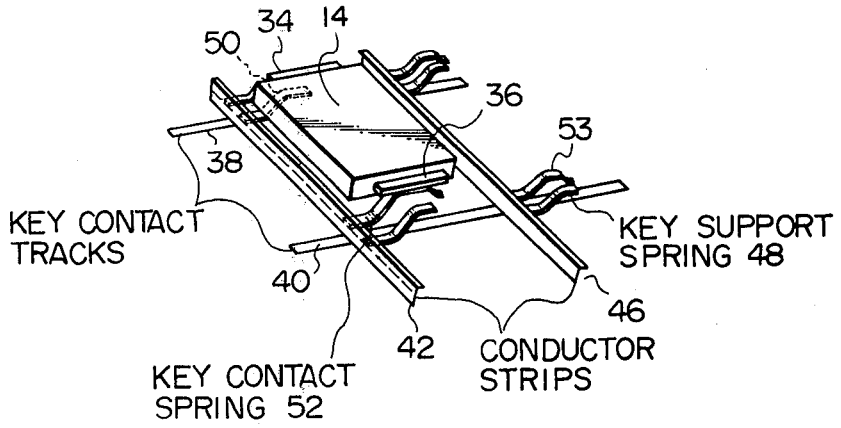
FIG. 3 is a view illustrating one of the keys of the preferred embodiment, and a portion of the row and column matrix of conductors.

FIG. 3 is a view illustrating a typical one of keys 14, which is contained within aperture 13 of FIG. 2 in key matrix plate 10. A matrix of conductors arranged outside the periphery of key 14 is composed of a set of conductor strips, two typical ones of which are denoted by numerals 42 and 46 in FIG. 3, and a set of tracks formed on printed circuit board 20, two typical ones of which are designated as key contact track 38 and key contact track 40. Each of the conductor strips is fixedly attached in a corresponding one of the key matrix plate rows by means of a longitudinal recess provided in the row. Thus, for example, conductor strips 42 and 46 are mounted in key matrix plate rows 30 and 32 respectively. A number of springs are attached to each of the conducting strips. Certain ones of these perform only a supporting function for the keys 14, and two typical ones of these are designated as key support spring 48 and key support spring 50, being attached to conductor strips 46 and 42 respectively. Key support spring 50 serves to partially support key 14, by urging a side tab portion 34 provided on key 14 upward against the lower face of aperture 27 in key matrix plate column 26. Other springs serve to establish contact between one of the conductor strips and one of the key contact tracks at an intersection between them, when a key located at that intersection is actuated. Two typical ones of these latter springs are designated as key contact spring 52 and key contact spring 53 in FIG. 3. Key contact spring 52 serves, for example, to partially support key 14 by urging a side tab portion 36 of key 14 in an upward direction against a lower face of recess 29 in key matrix plate column 28. When key 14 is actuated, key contact spring 52 is pushed into contact with a portion of key contact conductor strip 42 and key contact track 40. Each of keys 14 is supported in a similar manner to that shown in FIG. 3.

Referring again to FIG. 1B, numeral 23 denotes a connecting extension portion of printed circuit board 20, which carries a number of printed circuit tracks each of which is connected to a corresponding one of the conductor strips such as 42 and 46, and the key contact tracks such as 38 and 40.

Portions of each of the key contact tracks which are situated immediately below each of the key contact springs such as 52 and 53 are enlarged in area, to provide reliable contact, forming key contact pad areas. These key contact pads are omitted from FIG. 3, for simplifying the drawing as far as possible.

Each of keys 14 is transparent. A sheet or plate (not shown) upon which an array of items appears is positioned below transparent supporting plate 22, with each of the items thereon being arranged immediately below a corresponding one of keys 14. Each item is thus visible through the corresponding key. To generate data which designates a particular one of the items, the key corresponding to that item is actuated, thereby establishing contact between one of the conductor strips and one of the key contact tracks, at an intersection between them which is adjacent to the actuated key.

Figure 4:
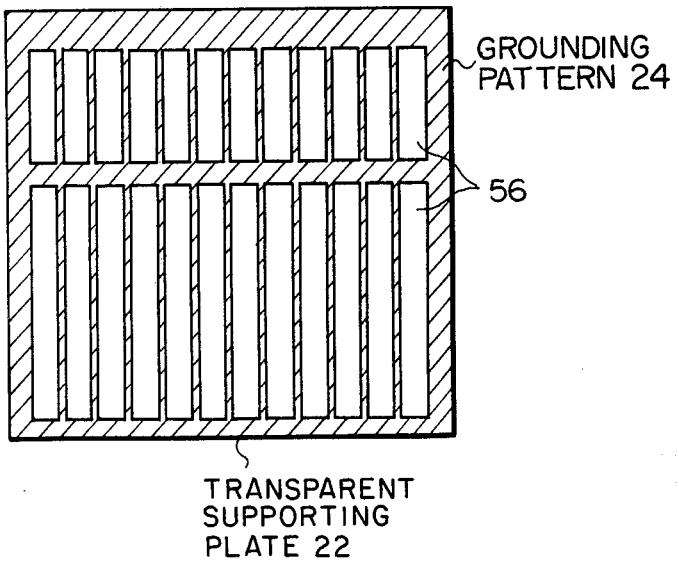
FIG. 4 is plan view of a conducting pattern formed on a transparent supporting plate of the preferred embodiment.

In order to prevent a build-up of static electric charge on transparent supporting plate 22, due to friction between the lower surface of supporting plate 22 and the sheets referred to above, on which the items appear, a pattern of conductive material is provided on the lower surface of transparent supporting plate 22. This conductive pattern, designated by reference numeral 24, is illustrated in FIG. 4. In order to permit unobstructed visibility through areas of transparent supporting plate 22 which are located immediately below keys 14, apertures of suitable size and shape, designated by numeral 56, are provided in conducting layer 24.

Figure 5:
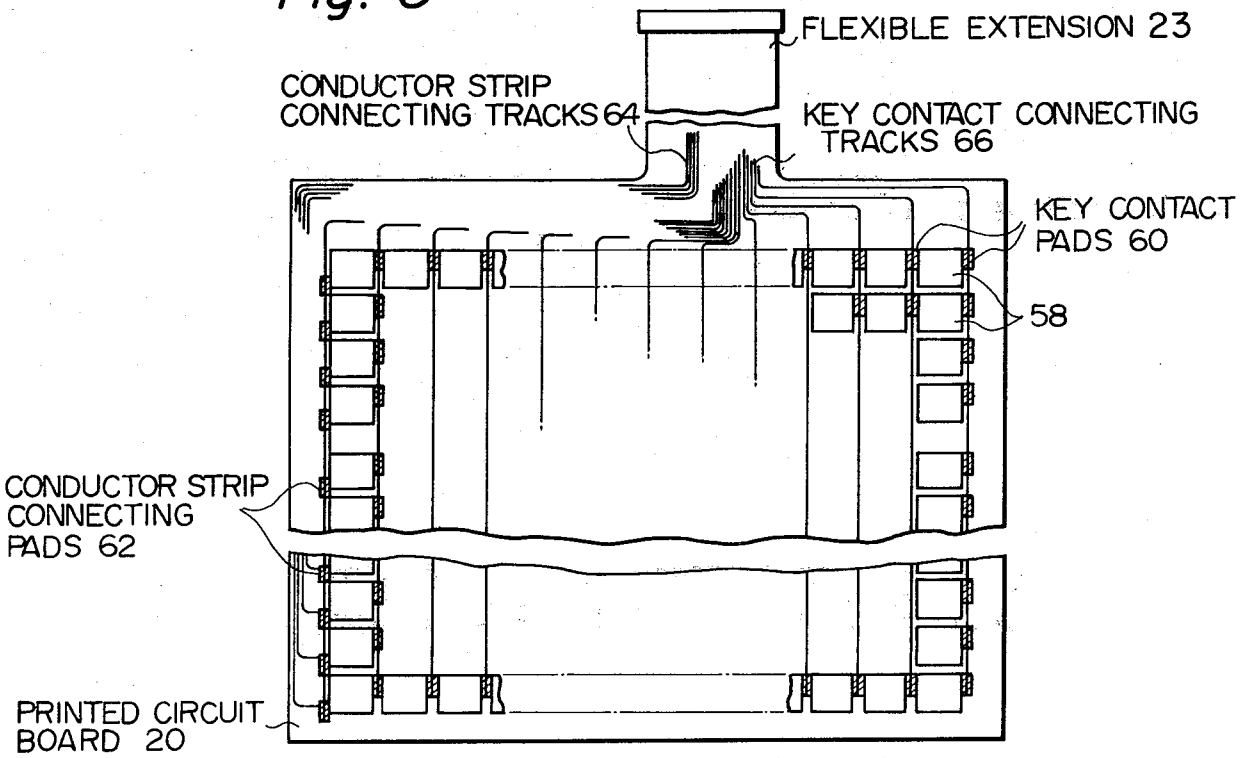
FIG. 5 is a partial plan view of a printed circuit board of the preferred embodiment.

Referring now to FIG. 5, a partial plan view of printed circuit board 20 is shown therein. The key contact pads on the key contact tracks, referred to hereinabove, are denoted by reference numeral 60. In order to provide unimpeded visibility through the keys 14 to the items which are to be designated, apertures 58 are provided in printed circuit board 20, with each of apertures 58 being positioned immediately below one of keys 14. Each of the conductor strips such as 42 and 46 in FIG. 3 is connected at one end thereof to a corresponding one of a set of conductor strip connecting pads 62. Each of conductor strip connecting pads 62 is connected to a corresponding one of a set of conductor strip connecting tracks 64, which extend from conductor strip connecting pads 62 to the outer end of flexible extension 23 of printed circuit board 20. Each of key contact pads 60 is connected to a corresponding one of a set of key contact connecting tracks 66, which extend from the key contact pads 60 to the outer end of flexible extension 23.

Connector means, such as a multi-contact plug or socket, may be readily attached to the outer end of flexible extension 23, whereby the key contact connecting tracks 66 and conductor strip connecting tracks 64 may be readily coupled to input terminals of a data-processing system or other equipment.

From the above description of the preferred embodiment, it will be apparent that the objectives set forth for the present invention are effectively attained. Since various changes and modifications to the above construction may be made without departing from the spirit and scope of the present invention, it is intended that all matter contained in the above description of the preferred embodiment shall be interpreted as illustrative, and not in a limiting sense. The appended claims are intended to cover all of the generic and specific features of the invention described herein.

What is claimed is:

1. A multi-item data input apparatus for manual generation of data to designate selected ones of a plurality of data items displayed upon a flat sheet, comprising a matrix plate having a plurality of apertures provided therein, each of said apertures corresponding in position to one of said items, a plurality of keys each being transparent in at least a portion thereof and movably supported within a corresponding one of said apertures, a plurality of row conductors consisting of conducting strips fixedly retained within said matrix plate, a plurality of column conductors disposed parallel to one another below said keys at right angles to said conducting strips, a plurality of contact springs fixedly attached and electrically connected to said conducting strips, with each of said contact springs being disposed with respect to one of said keys such as to contact one of said column conductors when said one of the keys is depressed, and a plurality of support springs fixedly attached to said conducting strips, with each of said support springs bearing against a lower face of a corresponding one of said keys and urging said key in a direction outward from said matrix plate, and wherein each of said contact springs bears against a lower face of one of said keys for urging said key in said outward direction, with each of said keys being limited with respect to movement in said outward direction by a portion thereof bearing against a lower face of said matrix plate.

2. A multi-item data input apparatus according to claim 1, and further comprising a printed circuit board disposed below said keys and matrix plate, said column conductors comprising conductive tracks formed on said printed circuit board, and moreover comprising a plurality of connecting tracks consisting of conductive tracks formed on said printed circuit board, with each of said connecting tracks being connected to a corresponding one of said column conductive tracks and said conducting strips, for establishing electrical contact therewith to external circuit means.

3. A multi-item data input apparatus according to claim 2, and further comprising a transparent supporting plate disposed below said printed circuit board for providing support thereto.

4. A multi-item data input apparatus according to claim 3, in which a pattern of conductive material is formed on a lower surface of said transparent supporting plate, for preventing accumulation of a static electric charge thereon, with apertures in said conducting pattern being provided in areas thereof situated immediately below each of said keys.

5. A multi-item data input apparatus for manual generation of data to designate selected ones of a plurality of data items displayed on a flat sheet, comprising:

a matrix plate having a plurality of apertures provided therein, each of said apertures corresponding in position to one of said items;

at least one support spring fixedly attached in a position adjacent to the periphery of each of said apertures in said matrix plate;

a plurality of keys, each being transparent in at least a central area thereof and movably supported within one of said apertures in said matrix plate by at least one of said support springs;

a plurality of contact springs and a plurality of fixed contact members, each of said contact springs and said fixed contact members being disposed adjacent to the periphery of at least one of said apertures in said matrix plate, and each of said contact springs being movably coupled to a corresponding one of said keys such as to be brought into contact with one of said fixed contact members when said corresponding one of the keys is depressed, to thereby generate data indicative of a selected data item on said flat sheet;

said support springs, said contact springs and said fixed contact members being disposed with respect to said matrix plate such as to be outside said transparent central area of each of said keys, whereby said data items on said flat sheet are visible through said transparent central areas of said keys when said multiple-item data input apparatus is placed over said flat sheet.

6. A multi-item data input apparatus according to claim 5, wherein each of said contact springs further serves, in co-operation with one of said support springs, to support a corresponding one of said keys.

7. A multi-item data input apparatus according to claim 5, and further comprising a printed circuit board disposed below said matrix plate and having a plurality of apertures formed therein, each of said apertures corresponding to a corresponding aperture in said matrix plate, and wherein said fixed contact members comprise a plurality of conductive tracks formed upon said printed circuit board.

8. A multi-item data input apparatus according to claim 7, and further comprising a supporting plate formed of a transparent material and disposed below said printed circuit board such as to provide support thereto.

9. A multi-item data input apparatus according to claim 8, and further comprising a pattern of a conducting material formed on a lower surface of said supporting plate, said pattern of conducting material having a plurality of apertures formed therein, with each of said apertures corresponding in position to an aperture in said matrix plate.

10. A multi-item data input apparatus according to claim 8, and further comprising a plurality of conductive tracks formed on said printed circuit board with each of said conductive tracks being electrically coupled to at least one of said contact springs.

11. A multi-item data input apparatus according to claim 10, and further comprising a flexible extension of said printed circuit board, integrally formed therewith, for electrically coupling said conductive tracks connected to said contact springs and said conductive tracks comprising the fixed contact members with external circuit means.

12. A multi-item data input apparatus for manual generation of data to designate selected ones of a plurality of data items displayed on a flat sheet, comprising, in combination:

a plurality of keys, each being transparent in at least a portion thereof;

a matrix plate having a plurality of apertures formed therein for movably retaining said keys, said apertures being defined by perpendicularly intersecting row and column members consisting of straight bars;

a plurality of row conductors comprising thin strips of a conductive material, each of said row conductors being fixedly mounted on a corresponding one of said matrix plate row members;

a printed circuit board disposed parallel to said matrix plate below said matrix plate and said conductive strips, having a plurality of apertures therein, each being positioned immediately below a corresponding one of said apertures in the matrix plate, and having a plurality of column conductors comprising conductive tracks formed thereon, each of said column conductors being positioned immediately below a corresponding one of said key matrix plate members;

a plurality of contact spring members, each fixedly mounted at one end thereof on one of said conductive strips, and bearing against a corresponding one of said keys, for urging said corresponding key in an upward direction, each of said keys being restrained with respect to movement in said upward direction by a portion thereof bearing against a lower surface of said matrix plate, each of said contact spring members being positioned to contact a corresponding one of said column conductor conductive tracks when said key corresponding thereto is depressed, whereby electrical contact is established between said column conductor and row conductor;

a plurality of support spring members, each fixedly mounted at one end thereof on one of said conductive strips, and bearing against a corresponding one of said keys, for urging said key in an upward direction;

a plurality of connecting tracks comprising conductive tracks formed on said printed circuit board with each of said connecting tracks being connected to a corresponding one of said row and column conductors for establishing electrical contact thereto with external circuit means; and a transparent supporting plate provided below said printed circuit board, for providing support thereto.

* * * * *